United States Patent [19]

Hagarty

[11] Patent Number: 4,667,629

[45] Date of Patent: May 26, 1987

[54] AIR-INTAKE DUCT FOR WORK VEHICLES

[75] Inventor: Jon R. Hagarty, Darien, Ill.

[73] Assignee: J. I. Case Company, Racine, Wis.

[21] Appl. No.: 837,805

[22] Filed: Mar. 10, 1986

[51] Int. Cl.[4] ..... F02M 35/04

[52] U.S. Cl. ..... 123/198 E; 55/385 B; 55/DIG. 28

[58] Field of Search ..... 123/198 E; 55/385 B, 55/DIG. 28

[56] References Cited

U.S. PATENT DOCUMENTS

| | | | |
|---|---|---|---|
| 1,691,536 | 11/1928 | Winslow et al. | 55/DIG. 28 |
| 2,671,521 | 3/1954 | Klemm et al. | 123/198 E |
| 2,708,920 | 5/1955 | Pasturczak | 55/385 B |
| 4,203,407 | 5/1980 | Fachbach et al. | 123/198 E |

*Primary Examiner*—William A. Cuchlinski, Jr.
*Attorney, Agent, or Firm*—Peter N. Jansson

[57] ABSTRACT

A pre-cleaning air-intake duct for connection to air cleaners on the internal combustion engines of work vehicles. The duct includes a horizontal distal end portion terminating in an end wall and has an upward opening in the main duct wall. The duct eliminates the need for baffling structures on the vehicle.

19 Claims, 3 Drawing Figures

AIR-INTAKE DUCT FOR WORK VEHICLES

FIELD OF THE INVENTION

This invention is related generally to air-intake systems for internal combustion engines on work vehicles such as tractors and, more particularly, to air-intake ducts for such systems.

BACKGROUND OF THE INVENTION

Work vehicles having internal combustion engines, such as tractors, road graders and the like, often operate in environments in which the air is filled with dust, dirt and grit. With such vehicles there is often more than the normal concern about cleaning the air used for combustion.

Because of such concern, such vehicles often include special baffling structures to effect the flow of air prior to the entry of such air into the intake ducts leading to the air cleaners on the internal combustion engines. Air cleaners, of course, have filters to remove very fine particulates so that the air entering the combustion chambers will be relatively clean. Without the use of special baffling structures to effect the air flow prior to its entry into the air cleaner duct and then into the air cleaner, coarser particulates can quickly clog the filters in the air cleaner. Without such baffling structures, air filters have to be changed much more frequently.

In a typical arrangement for a tractor with a front-mounted engine, the air cleaner is located above the engine block and an air cleaner duct extends from the air cleaner forwardly over the fan and over the radiator to terminate in a forward position near the upper edge of the tractor grille. Air flows into the distal end of the air duct at that location and from there into the air cleaner. One or more baffles, typically metal pieces, are attached to the tractor near the grille in position to prevent the air passing through the grille from going directly into the air duct.

The action of the engine fan, of course, causes air to flow at a relatively high rate through the grille, and the baffling is positioned to require such air coming through the grille to change both its speed and direction by going through a tortuous path before being admitted into the open distal end of the air-intake duct. The change or changes in both direction and speed of the air flow caused by such baffling causes the coarser and heavier dust and dirt particulars to "fall out," so that particulates entering the air-intake duct and then the air cleaner are primarily very fine particulates.

The use of such baffling structures to create a tortuous path for intake air causes unnecessary structural complexity and inaccessibility under the hood of the work vehicle, and adds unnecessary cost. There has been a need for an improved air-intake system for work vehicles. More specifically, there has been a need for a simple air-intake duct which eliminates the need for vehicle-mounted baffle structures for creation of a tortuous air path. There has been a need for an improved duct which accomplishes these purposes without just transferring the baffles and complexity to the duct itself.

SUMMARY OF THE INVENTION

This invention is an improved simple air-intake duct which eliminates the need for vehicle-mounted baffling structures in order to create a sufficient tortuous path to remove coarse particulates from intake air. This invention overcomes the disadvantages described above, removing a degree of complexity under the work vehicle hood and adding a degree of accessibility for normal vehicle maintenance.

The pre-cleaning air-intake duct of this invention, like prior air-intake ducts, has a main duct wall and extends from a proximal end connected to an air cleaner on a vehicle internal combustion engine to a distal end away from the air cleaner. The pre-cleaning air-intake duct of this invention, however, includes a substantially horizontal distal end portion which terminates in an end wall and which has an upward opening in the main duct wall. Such distal end portion is a length of the duct near its end, and such distal end portion is typically located forward of the vehicle radiator.

In preferred embodiments, the distal end portion is straight and the end wall is substantially vertical. The end wall preferably has an upper edge bounding the upward opening. The main duct wall is preferably oval in cross-section, at least along the distal end portion and most preferably along most of its length. The air-intake duct includes upper and lower portions along its length which are joined at side portions defining the width of the duct. The upward opening in the distal end portion of the duct is along the upper portion and preferably has a width less than the width of the duct.

The air-intake duct, including the distal end portion, is spaced immediately below and closely adjacent to the vehicle hood. The end wall of the distal end portion is preferably adjacent to the grille.

The upward opening in the main duct wall along the distal end portion of such duct eliminates the need for any baffling mounted to the vehicle near the distal end of the duct. Since the air-intake duct, particularly the distal end portion thereof, is near the vehicle hood, the duct configuration requires that high-speed air coming through the grille change speed and direction in order to enter the duct.

In particular, the upward opening therein and the fact that the distal end portion terminates in an end wall blocking direct air intake from the grille stream require that the air pass through a tortuous path in order to enter the air-intake duct. Yet the air-intake duct can remain a simple substantially straight tubular member.

As the air bends around the distal end portion of the airintake duct and enters the upward opening thereof, its velocity is considerably lower than the velocity of the air stream being drawn through the grille by the engine fan. This change of direction and lowering of air velocity releases the heavier particulates which would enter conventional air-intake ducts if it were not for the baffling structures which have been used on the vehicles near the ends of such conventional ducts.

The change in air-stream speed and direction caused by the air-intake duct of this invention without vehicle baffling structures allows the heavy particulates to drop back into the main air stream created by the engine fan. Thus, the engine air cleaner is protected from premature clogging.

OBJECTS OF THE INVENTION

It is an object of this invention to provide an air-intake duct for work vehicles which overcomes some of the disadvantages of prior air-intake ducts.

Another object of this invention is to provide an improved air-intake duct which allows the elimination of engine-mounted baffling to create a tortuous path for air flowing into the airintake duct.

Another object of this invention is to provide an improved simple air-intake duct for work vehicles which eliminates complexity and provides greater accessibility under the vehicle hood.

These and other objects will be apparent from the following additional descriptions and from the drawings, wherein:

DETAILED DESCRIPTION OF PREFERRED EMBODIMENTS

Figure 1:
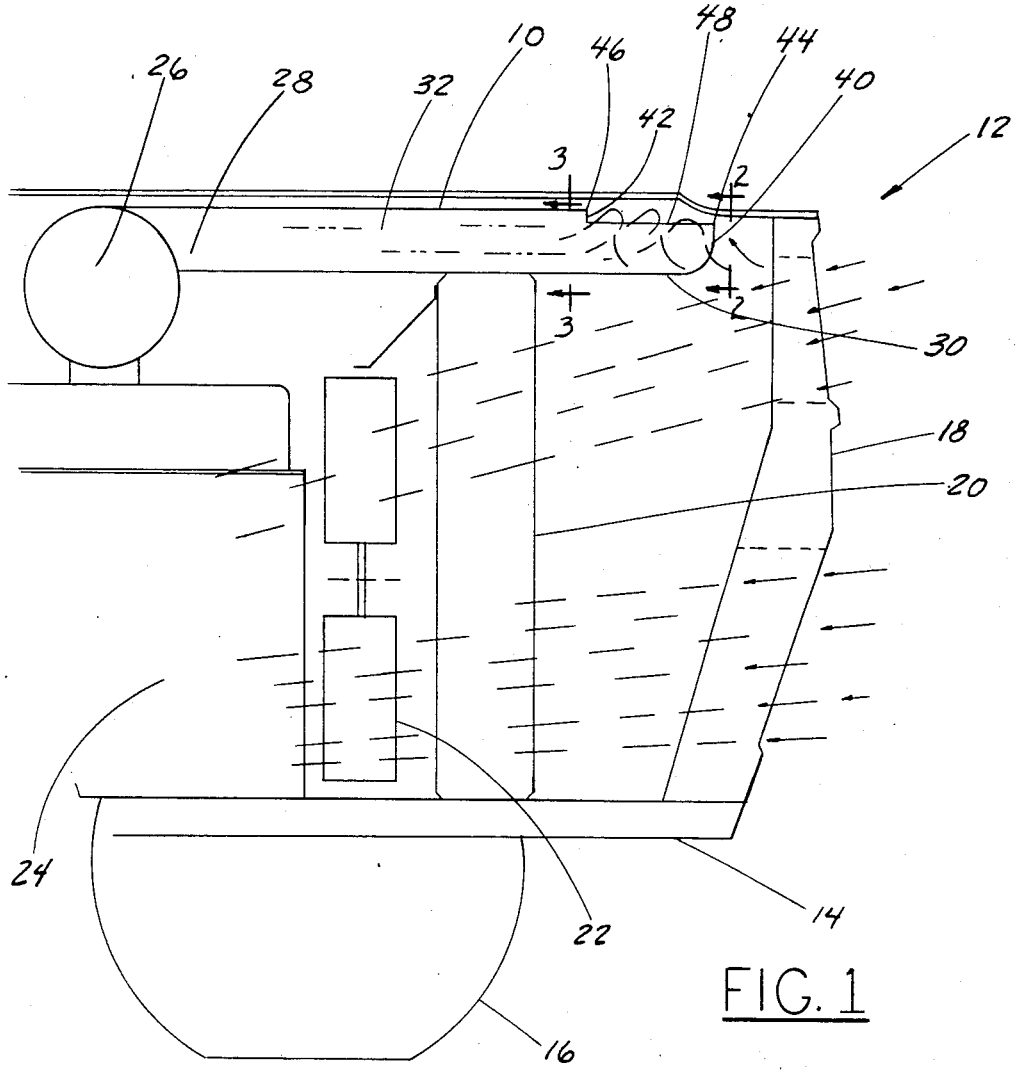
FIG. 1 is a fragmentary semi-schematic cut-away side elevation of a tractor utilizing the air-intake duct of this invention.

FIG. 1 illustrates the air-intake duct of this invention mounted in proper position on a field tractor 12. Tractor 12 includes a chassis 14, a front wheel 16, a grille 18, a radiator 20, an engine fan 22, an engine block 24 and an air cleaner 26. Air-intake duct 10 is connected to air cleaner 26.

Air-intake duct 10 is connected to air cleaner 26 at its proximal end 28. Air-intake duct 10 extends forwardly in a generally horizontal direction just beneath the hood of tractor 12. Air-intake duct 10 extends to a distal end 30 which is located near the upper edge of grille 18. Air-intake duct 10 has an oval wall 32 which is constant in size and shape at all locations along the length of duct 10, except for the portion near distal end 30 where a portion of oval wall 32 is missing to create upward opening 42.

Figure 3:
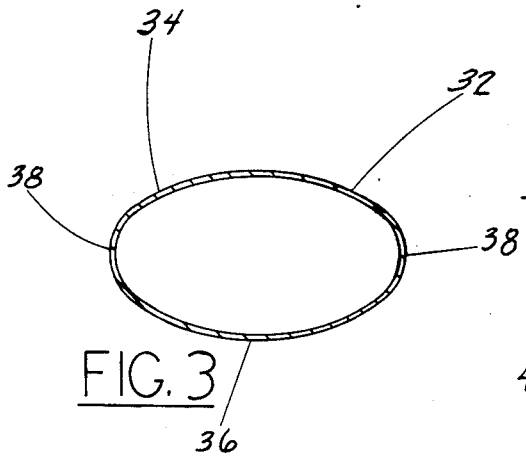
FIG. 3 is a side sectional (without background) taken along section 3—3, as indicated in FIG. 1, illustrating only the air-intake duct.
Figure 2:
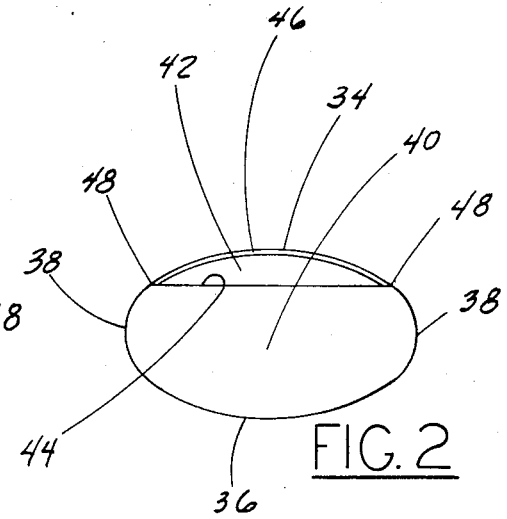
FIG. 2 is a right side sectional (without background) taken along section 2—2, as indicated in FIG. 1, of the air-intake duct of FIG. 1 with all other parts of the tractor removed.

Air-intake duct 10 is generally straight along most of its length, although it may have a portion near proximal end 28 which turns to accommodate its connection with air cleaner 26. The portion of duct 10 near distal end 30 is straight. Along its length, air-intake duct 10 has an upper portion 34 and a lower portion 36. Upper portion 34 and lower portion 36 are joined at opposite side portions 38, as illustrated in FIGS. 2 and 3.

Duct 10 has a distal end portion which terminates in a closed end wall 40. As noted, there is an upward opening 42 in duct 10 at such distal end portion. Upward opening 42 is defined by the end wall edge 44, by the upper portion forward edge 46, and by two parallel side edges 48 each of which interconnects the ends of end wall edge 40 and upper portion forward edge 46 to define upward opening 42. Upward opening 42 is closely adjacent to the hood of tractor 12.

Closed end wall 40, and lower portion 36 and side portions 38 of oval wall 32 of air-intake duct 10 cause air which is being drawn through grille 18 to change directions radically in order to enter upward opening 42. This occurs without any baffling structure mounted to the tractor.

As illustrated in FIG. 1, engine fan 22 draws air rapidly through grille 18 and radiator 20 in a direction toward engine block 24. Such air is often full of relatively coarse particulates of a type which could prematurely clog the filter of air cleaner 26. Air-intake duct 10 in itself acts as a pre-cleaner of intake air and thus extends the life of the filter in air cleaner 26.

The pre-cleaning air-intake duct of this invention may be made of well-known heat-resistant plastics using well-known plastic molding methods, or in a variety of other ways. One acceptable plastic material is a product of Shell Oil Company identified as Shell 5220 Black, which may be blow-molded. Metals may also be used. The air-intake duct of this invention may be completely hollow or may have some internal ribbing or other reinforcing structures.

The upward opening in the air-intake duct of this invention preferably has an air-intake area at least equal to the cross-sectional area of the duct at locations closer to the air cleaner. And, the duct should be substantially free from collapsing or other distortions which would reduce the interior cross-sectional area at any point.

Air-cleaner duct 10 of this invention can have a variety of shapes and configurations. However, it is noted that the advantages of this invention may be achieved with simplicity of design and manufacture.

While the principles of this invention have been described in connection with specific embodiments, it should be understood clearly that these descriptions are made only by way of example and are not intended to limit the scope of the invention.

What is claimed:

1. An air-intake duct of the type having a main duct wall and extending from a proximal end connected to an air cleaner on a vehicle internal combustion engine in a forward direction toward a vehicle front to a distal end away from the air cleaner, the improvement comprising a substantially horizontal distal end portion terminating in a forward end wall extending transverse said forward direction to block direct air intake from the vehicle front and having an upward opening in the main duct wall, whereby particulates are removed from intake air without complex baffling or the like.

2. The air-intake duct of claim 1 wherein the end wall has an upper edge bounding said upward opening.

3. The air-intake duct of claim 1 wherein the distal end portion is straight and the end wall is substantially vertical.

4. The air-intake duct of claim 1 having a substantially constant cross-sectional area along its length from its distal end to beyond its distal end portion.

5. The air-intake duct of claim 4 wherein the main duct wall is oval in cross-section along the distal end portion.

6. The air-intake duct of claim 1 wherein the main duct wall includes upper and lower portions therealong which are joined at side portions defining the width of the duct, said upward opening in the distal end portion of the duct being along said upper portion and having a width less than the width of the duct.

7. The air-intake duct of claim 6 wherein the end wall has an upper edge bounding said upward opening.

8. The air-intake duct of claim 7 wherein the distal end portion is straight and the end wall is substantially vertical.

9. The air-intake duct of claim 8 having a substantially constant cross-sectional area along its length from its distal end to beyond its distal end portion.

10. The air-intake duct of claim 9 wherein the main duct wall is oval in cross-section along the distal end portion.

11. In a work vehicle of the type having an internal combustion engine under a hood, including an air-intake duct having a main duct wall and extending from a proximal end connected to an air cleaner in a forward direction toward a vehicle front to a distal end away from the air cleaner, the improvement wherein the air-intake duct includes a substantially horizontal distal end portion terminating in a forward end wall extending transverse said forward direction to block direct air intake from the vehicle front and having an upward opening in the main duct wall, whereby particulates are removed from intake air without complex baffling or the like.

12. The apparatus of claim 11 wherein the main duct wall includes upper and lower portions therealong which are joined at side portions defining the width of the duct, said upward opening in the distal end portion of the duct being along said upper portion and having a width less than the width of the duct.

13. The apparatus of claim 11 wherein the distal end portion is spaced immediately below the vehicle hood.

14. The apparatus of claim 13 further including a fan adjacent to the engine, a radiator adjacent to the fan, and a grille adjacent to the radiator, and wherein the air-intake duct spans the fan and radiator, and said end wall of said distal end portion is adjacent to the grille.

15. The apparatus of claim 14 wherein the end wall has an upper edge bounding said upward opening.

16. The apparatus of claim 15 wherein the distal end portion is straight and the end wall is substantially vertical.

17. The apparatus of claim 14 wherein the main duct wall includes upper and lower portions therealong which are joined at side portions defining the width of the duct, said upward opening in the distal end portion of the duct being along said upper portion and having a width less than the width of the duct.

18. The apparatus of claim 17 wherein said air-intake duct has a substantially constant cross-sectional area along its length from its distal end to beyond its distal end portion.

19. The apparatus of claim 18 wherein the main duct wall is oval in cross-section along the distal end portion.

* * * * *